US011652291B2

(12) United States Patent
Leung et al.

(10) Patent No.: US 11,652,291 B2
(45) Date of Patent: May 16, 2023

(54) TRI-FREQUENCY MULTI-POLARISATION OMNIDIRECTIONAL ANTENNA

(71) Applicant: CITY UNIVERSITY OF HONG KONG, Kowloon (HK)

(72) Inventors: Kwok Wa Leung, Kowloon (HK); Peng Fei Hu, Kowloon (HK)

(73) Assignee: CITY UNIVERSITY OF HONG KONG, Kowloon (HK)

( * ) Notice: Subject to any disclaimer, the term of this patent is extended or adjusted under 35 U.S.C. 154(b) by 93 days.

(21) Appl. No.: 17/331,388

(22) Filed: May 26, 2021

(65) Prior Publication Data

US 2022/0384950 A1 Dec. 1, 2022

(51) Int. Cl.
*H01Q 5/30* (2015.01)
*H01Q 7/00* (2006.01)

(52) U.S. Cl.
CPC ..... *H01Q 5/30* (2015.01); *H01Q 7/00* (2013.01)

(58) Field of Classification Search
CPC ..... H01Q 5/30; H01Q 7/00
See application file for complete search history.

(56) References Cited

U.S. PATENT DOCUMENTS

2018/0006355 A1* 1/2018 Qing ..... H01Q 1/38
2020/0136230 A1* 4/2020 Hung ..... H01Q 1/48
2020/0185832 A1* 6/2020 Ross, III ..... H01Q 5/378
2020/0194874 A1* 6/2020 De Sousa ..... H01Q 7/00
2020/0203852 A1* 6/2020 Saitou ..... H01Q 21/06
2020/0251814 A1* 8/2020 Ryu ..... H01Q 7/00
2020/0314566 A1* 10/2020 Perri ..... H01Q 1/273
2020/0335865 A1* 10/2020 Greve ..... H01P 5/12
2020/0343314 A1* 10/2020 Nakamura ..... H01L 27/3276
2020/0381802 A1* 12/2020 Matsushima ..... H01Q 1/2283
2020/0411990 A1* 12/2020 Nakamura ..... H01Q 7/00
2021/0013629 A1* 1/2021 Sharawi ..... H01Q 21/24
2021/0036425 A1* 2/2021 Jain ..... G02C 7/04
2021/0041515 A1* 2/2021 Dolgin ..... H01Q 7/00
2021/0058570 A1* 2/2021 Sato ..... H01Q 7/00
2021/0098879 A1* 4/2021 Takeuchi ..... G06K 7/0004
2021/0104815 A1* 4/2021 Liu ..... H01Q 5/30
2021/0110232 A1* 4/2021 Ueki ..... G06K 19/07771
2021/0152680 A1* 5/2021 Lee ..... H04M 1/0266

* cited by examiner

*Primary Examiner* — Ab Salam Alkassim, Jr.
*Assistant Examiner* — Bamidele A Jegede

(57) ABSTRACT

A tri-frequency multi-polarisation omnidirectional antenna comprising: a first plurality of curved electrically conductive strips arranged on the first face and being arranged to form an outer-loop; second plurality of curved electrically conductive strips arranged on the first face and being arranged to form an inner-loop; third plurality of curved electrically conductive strips arranged on the first face and being arranged to form middle-loop; a first power divider and a second power divider each connected to the strips of the inner-loop; a dielectric resonator comprising a first face, the first face arranged on the first face of the substrate; an electrically conductive probe being arranged at least partially within the dielectric resonator and extending at least part way along the symmetry axis.

16 Claims, 13 Drawing Sheets

TRI-FREQUENCY MULTI-POLARISATION OMNIDIRECTIONAL ANTENNA

FIELD OF THE INVENTION

The present invention relates to a tri-frequency multi-polarisation omnidirectional antenna. More particularly, but not exclusively, the present invention relates to a tri-frequency multi-polarisation omnidirectional antenna comprising a substrate having a plurality of electrically conducting loops arranged thereon the loops being dimensioned to excite horizontally polarised TE modes at a plurality of frequencies and a dielectric resonator arranged on the substrate, the dielectric resonator having an electrically conductive probe extending therethrough substantially normal to the substrate to excite vertically polarised TM modes in the dielectric resonator at a plurality of frequencies.

BACKGROUND

Wi-Fi coverage is improved when one employs a plurality of different frequencies and also a plurality of different polarisations. At present there is no single antenna which can simultaneously provide both a plurality of frequencies and polarisations. A plurality of antennas needs to be employed.

The present invention seeks to overcome the problems of the prior art.

STATEMENT OF INVENTION

Accordingly, the present invention provides a tri-frequency multi-polarisation omnidirectional antenna comprising:

- an electrically insulating substrate comprising first and second faces;
- a first plurality of curved electrically conductive strips arranged on the first face and being arranged to form an outer loop with each strip being spaced apart from the adjacent strip of the loop;
- a second plurality of curved electrically conductive strips arranged on the first face and being arranged to form an inner loop with each strip being spaced apart from the adjacent strip of the loop;
- a third plurality of curved electrically conductive strips arranged on the first face and being arranged to form middle loop with each strip being spaced apart from the adjacent strip of the loop;
- the three loops being concentric with each loop centered on a common symmetry point, the axis normal to the first face and passing through the common symmetry point being the symmetry axis;
- the middle loop having a larger diameter than the inner loop and the outer loop having a larger diameter than the middle loop;
- a first power divider connected to the strips of the outer loop;
- a second power divider connected to the strips of the inner loop;
- a dielectric resonator comprising a first face, the first face arranged on the first face of the substrate;
- an electrically conductive probe being arranged at least partially within the dielectric resonator and extending at least part way along the symmetry axis.

The tri-frequency multi-polarisation omnidirectional antenna according to the invention can operate simultaneously at three different frequencies (for example 2.4, 5.2 and 5.8 GHz Wi-Fi bands) and also in both TE and TM modes for dual orthogonal polarisation. This improves Wi-Fi coverage. The antenna is also compact and simple to manufacture.

Preferably the loops are circular. This mitigates gain variation in the azimuthal plane and so increases uniformity of coverage.

Preferably the dielectric resonator is cylindrical and comprises first and second faces and a side wall extending therebetween, the resonator comprising a dielectric axis extending from the center of the first face to the center of the second face, the dielectric axis being coaxial with the symmetry axis. A cylindrical shape is preferable for obtaining uniform signal coverage.

Preferably the dielectric resonator comprises at least one step change in diameter part way along its length.

Preferably the dielectric resonator is dimensioned such that when excited by a microwave signal provided to it by the probe it excites vertically polarised TM modes in a lower band and an upper band, the lower band containing 2.4 GHz and the upper band containing 5.2 GHz and 5.8 GHz.

Preferably the dielectric resonator is glass.

Preferably the tri-frequency multi-polarisation omnidirectional antenna as further comprises a probe signal source connected to the probe, the probe signal source being configured to provide a microwave signal at at least one of 2.4 GHz, 5.2 GHz and 5.8 GHz.

Preferably the loops are circular.

Preferably the middle loop is arranged proximate to the inner loop such that the two are electrically coupled together to form a composite electrical structure.

Preferably the strips of composite electrical structure are dimensioned such that when excited by a microwave signal the composite electrical structure excites horizontally polarised TE modes in an upper frequency band, the upper frequency band containing 5.2 GHz and 5.8 GHz.

Preferably the tri-frequency multi-polarisation omnidirectional antenna further comprises a second signal source connected to the second power divider, the second signal source being configured to provide a microwave signal at at least one of 5.2 GHz and 5.8 GHz.

Preferably the strips of the outer loop are dimensioned such that when excited by a microwave signal the outer loop excite a horizontally polarised TE mode in a lower frequency band, the lower frequency band containing 2.4 GHz.

Preferably the tri-frequency multi-polarisation omnidirectional antenna further comprises a first signal source connected to the first power divider, the first signal source being configured to provide a microwave signal at 2.4 GHz.

Preferably the tri-frequency multi-polarisation omnidirectional antenna further comprises an electrically conductive ground plane on the second side of the substrate.

Preferably the tri-frequency multi-polarisation omnidirectional antenna further comprises a ring slot in the ground plane.

Preferably the tri-frequency multi-polarisation omnidirectional antenna further comprising a recess in the first face of the dielectric resonator arranged about the symmetry axis.

BRIEF DESCRIPTION OF THE DRAWINGS

The present invention will now be described by way of example only and not in any limitative sense with reference to the accompanying drawings in which.

Figure 1:
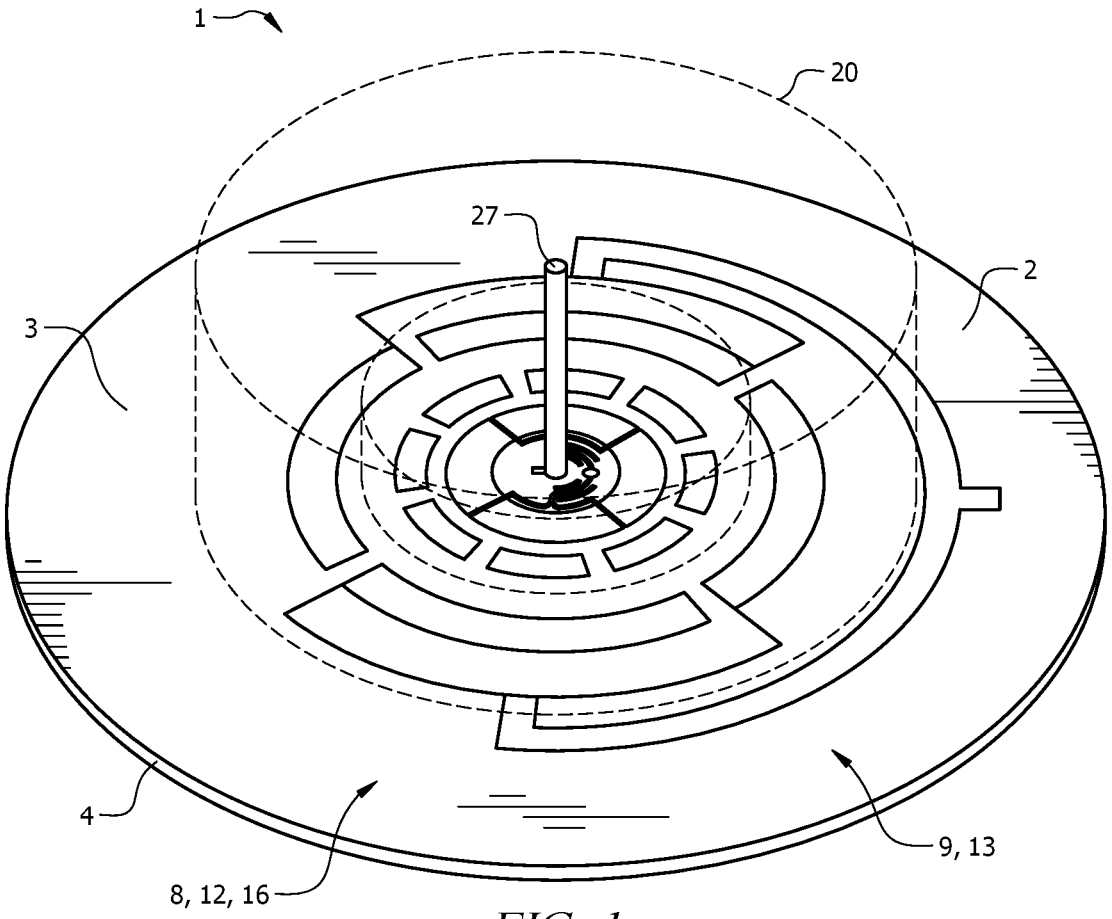
FIG. 1 shows, in perspective view, a tri-frequency multi-polarisation omnidirectional antenna according to the invention.

Shown in FIG. 1 is a tri-frequency multi-polarisation omnidirectional antenna 1 according to the invention. The tri-frequency multi-polarisation omnidirectional antenna 1 comprises an electrically insulating substrate 2 having first and second faces 3, 4. Arranged on the first face 3 is a plurality of loops 8, 12, 16 and power dividers 9, 13 which are described in more detail with reference to FIG. 2. Also arranged on the first face 3 is a dielectric resonator 20 having an electrically conductive probe 27 arranged therein. This is described in more detail with reference to FIG. 3.

Figure 2:
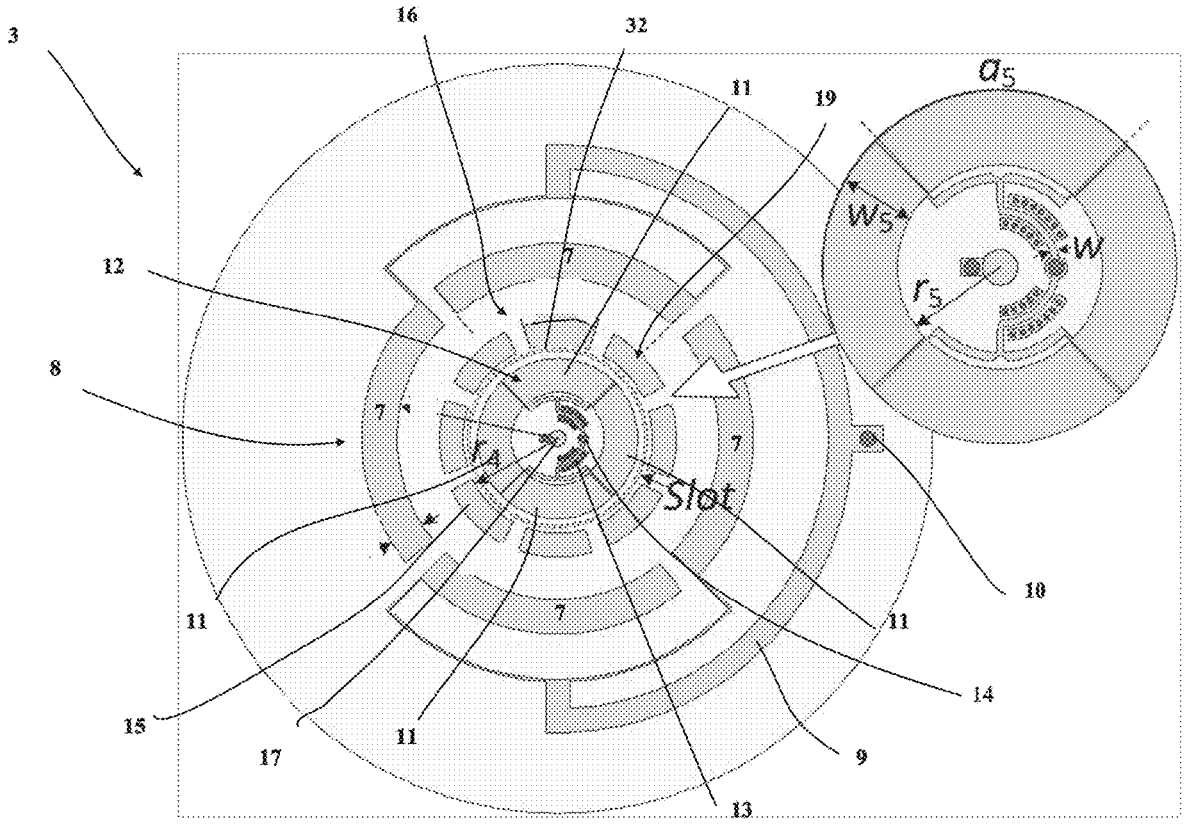
FIG. 2 shows the first face of the electrically insulating substrate of the antenna of FIG. 1 in plain view from above.

Shown in FIG. 2 is the first face 3 of the electrically insulating substrate 2 in plain view. Arranged on the first face 3 is a first plurality of curved electrically conductive strips 7. The strips 7 are arranged to form an outer circular loop 8 with each strip 7 separated from each adjacent strip 7 of the loop 8 as shown. Connected to the strips 7 of the outer loop 8 is a first power divider 9. The first power divider 9 receives a microwave signal from a first port 10 and provides it to each of the curved strips 7. The curved strips 7 of the outer loop 8 are dimensioned such that when excited by a microwave signal from the first port 10 the outer loop 8 excites a horizontally polarised TE mode in a lower frequency band, the lower frequency band containing 2.4 GHz.

Also arranged on the first face 3 is a second plurality of curved electrically conductive strips 11. The strips 11 are arranged to form a circular inner loop 12 with each strip 11 separated from each adjacent strip 11 in the loop 12 as shown. Connected to the strips 11 of the inner loop 12 is a second power divider 13 which receives a microwave signal from a second port 14 and provides it to each of the curved strips 11.

Also arranged on the first face 3 is a third plurality of curved electrically conductive strips 15. The strips 15 are arranged to form a circular middle loop 16 with each strip 15 separated from each adjacent strip 15 in the loop 16 as shown.

The outer, inner and middle loops 8, 12, 16 are concentric with each loop 8, 12, 16 centered on a common symmetry point 17. The axis 18 passing through the common symmetry point 17 normal to the first face 3 of the substrate 2 is termed the symmetry axis 18.

The middle loop 16 has a larger diameter than the inner loop 12. The outer loop 8 has a larger diameter than the middle loop 16. The middle loop 16 is arranged proximate to the inner loop 12 such that the two are electrically coupled together to form a composite electrical structure 19. The effect of this is that the parasitic strips 15 of the middle loop 16 tune the modes of the inner loop 12.

The curved strips 11, 15 of the composite electrical structure 19 are dimensioned such that when excited by a microwave signal from the second port 14 the composite electrical structure 19 excites horizontally polarised TE modes in an upper frequency band, the upper frequency band containing 5.2 GHz and 5.8 GHz.

Figure 3:
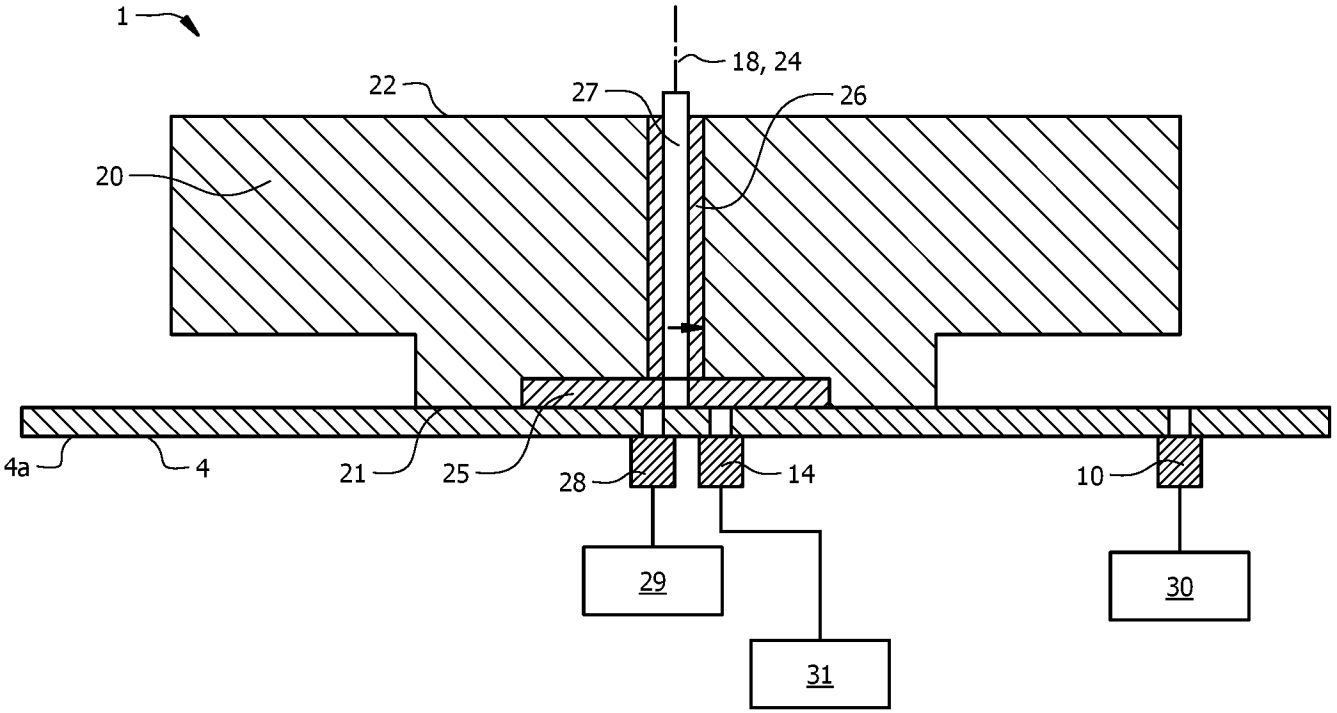
FIG. 3 shows the tri-frequency multi-polarisation omnidirectional antenna of FIG. 1 in vertical cross section.
Figure 4A:
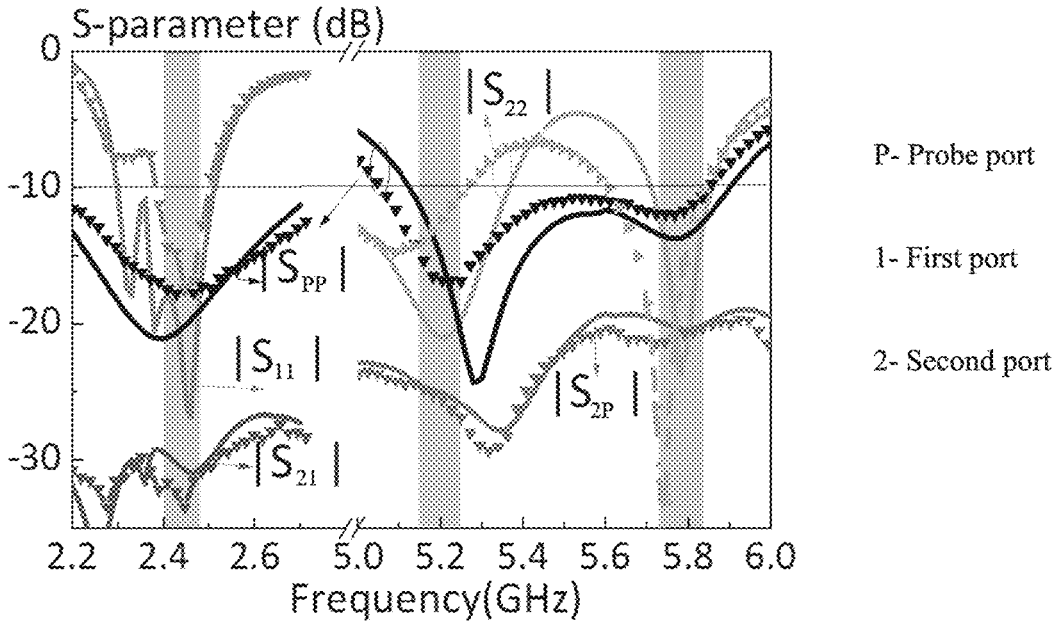
FIGS. 4(*a*) to 4(*d*) show simulated and measured parameters of an antenna according to the invention.
Figure 4B:
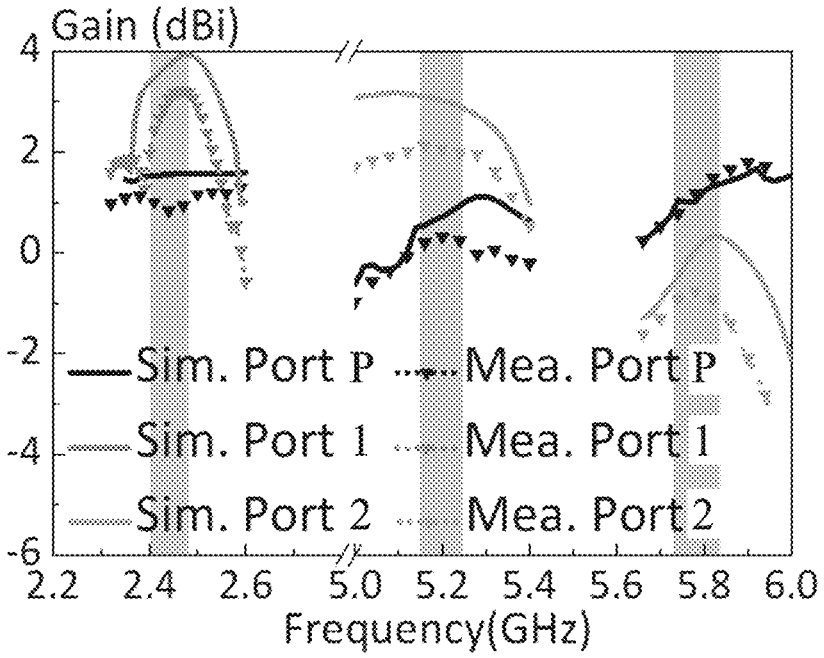
Figure 4C:
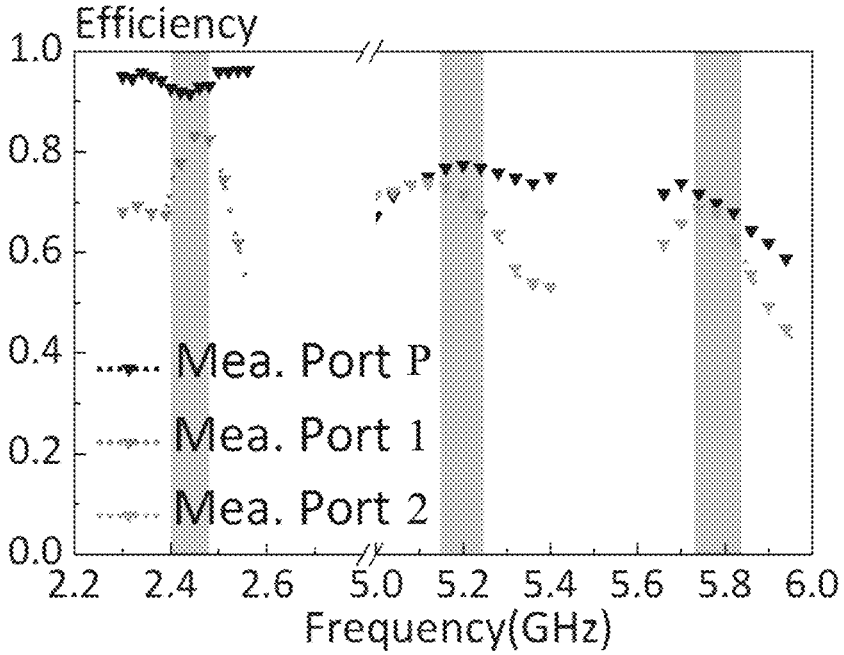
Figure 4D:
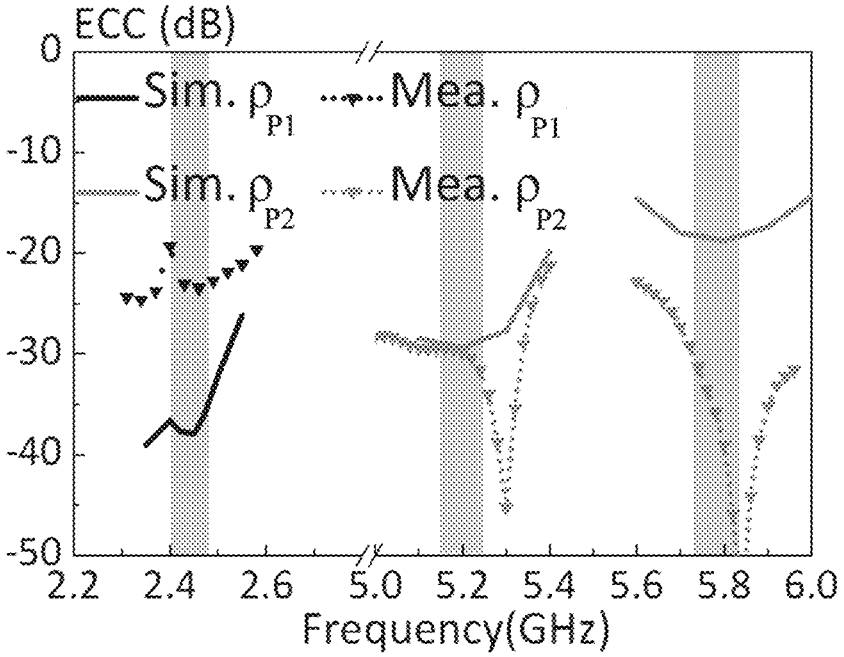
Figure 5A:
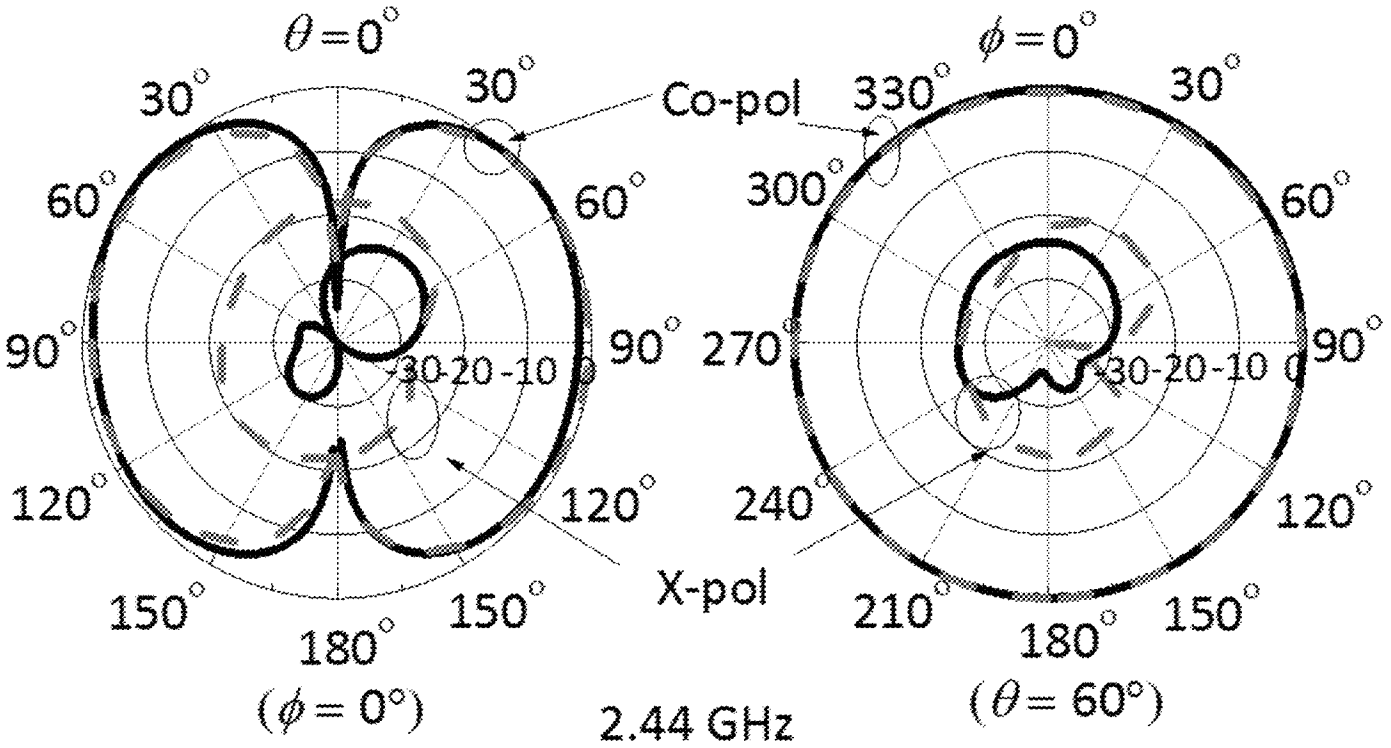
FIGS. 5(*a*) to 5(*f*) show simulated and measured normalised radiation patterns from the antenna.
Figure 5B:
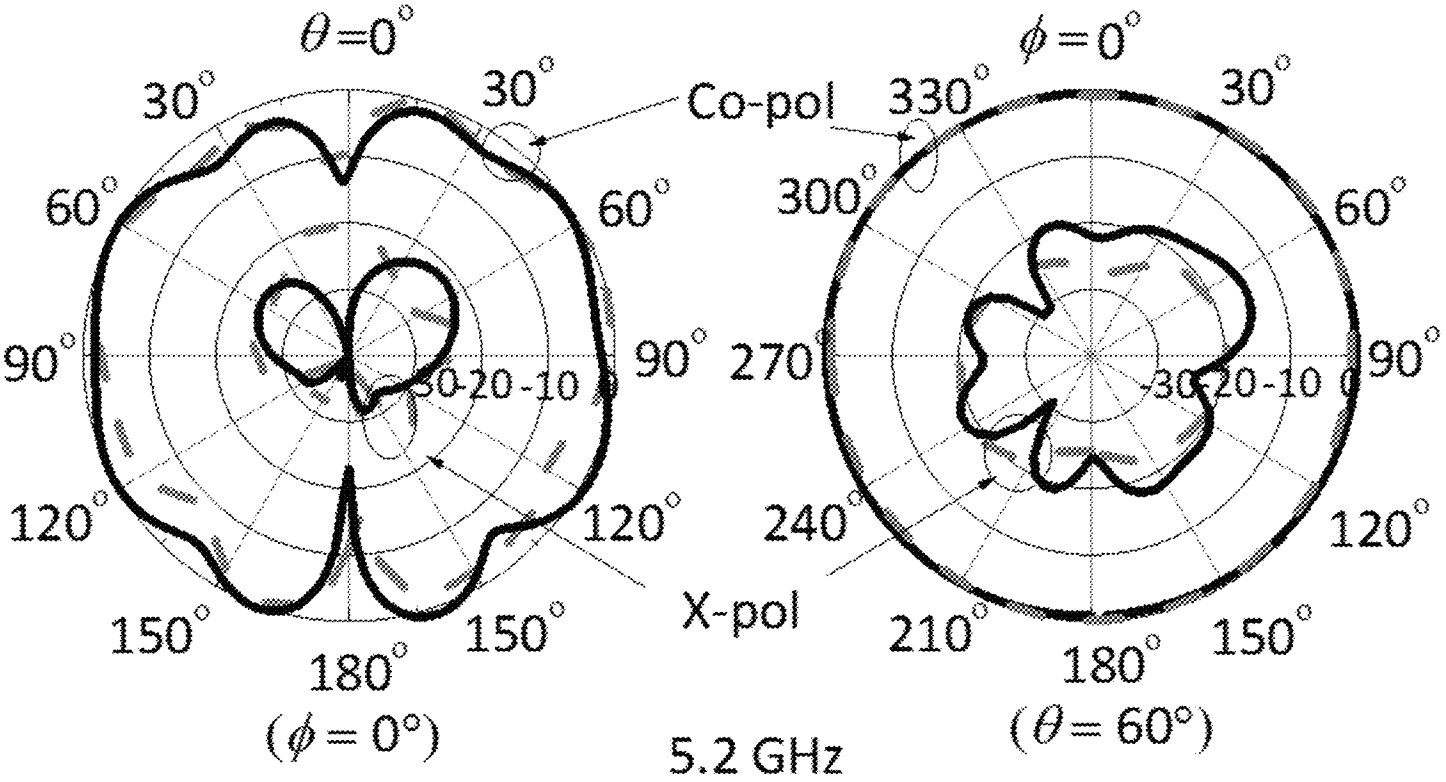
Figure 5C:
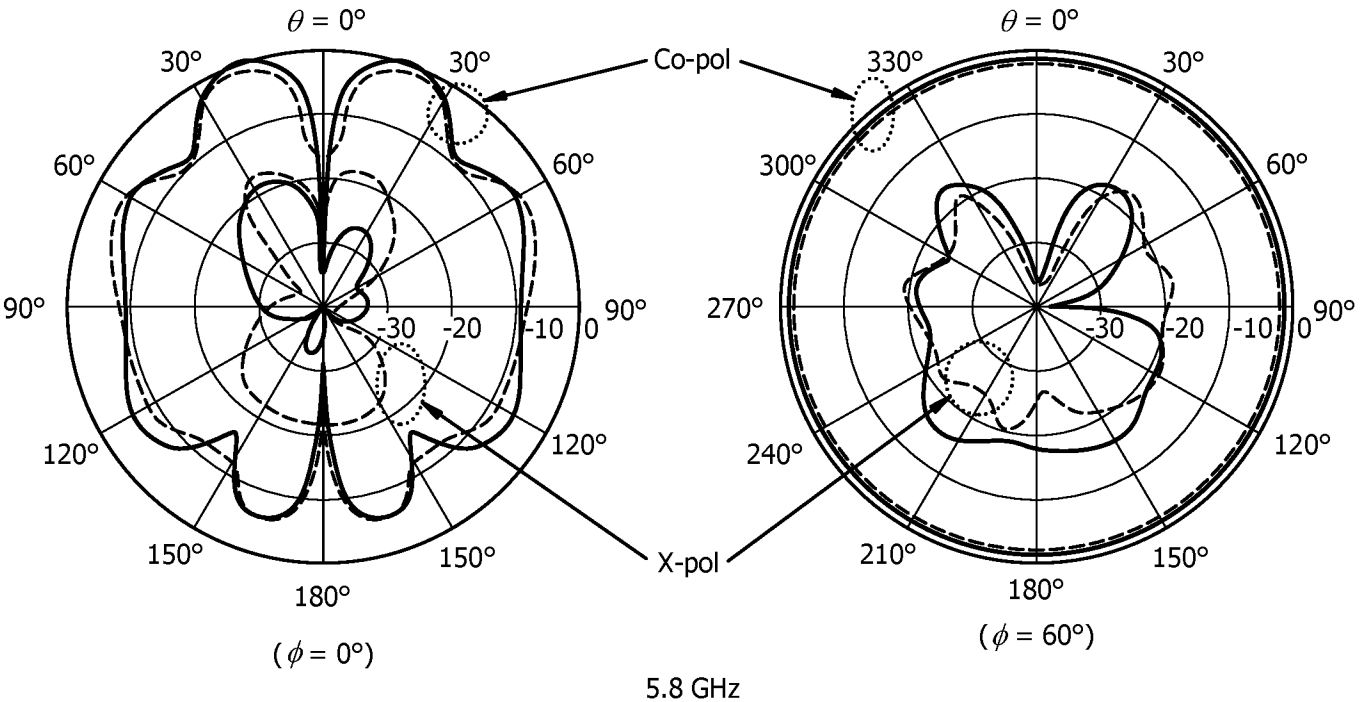
Figure 5D:
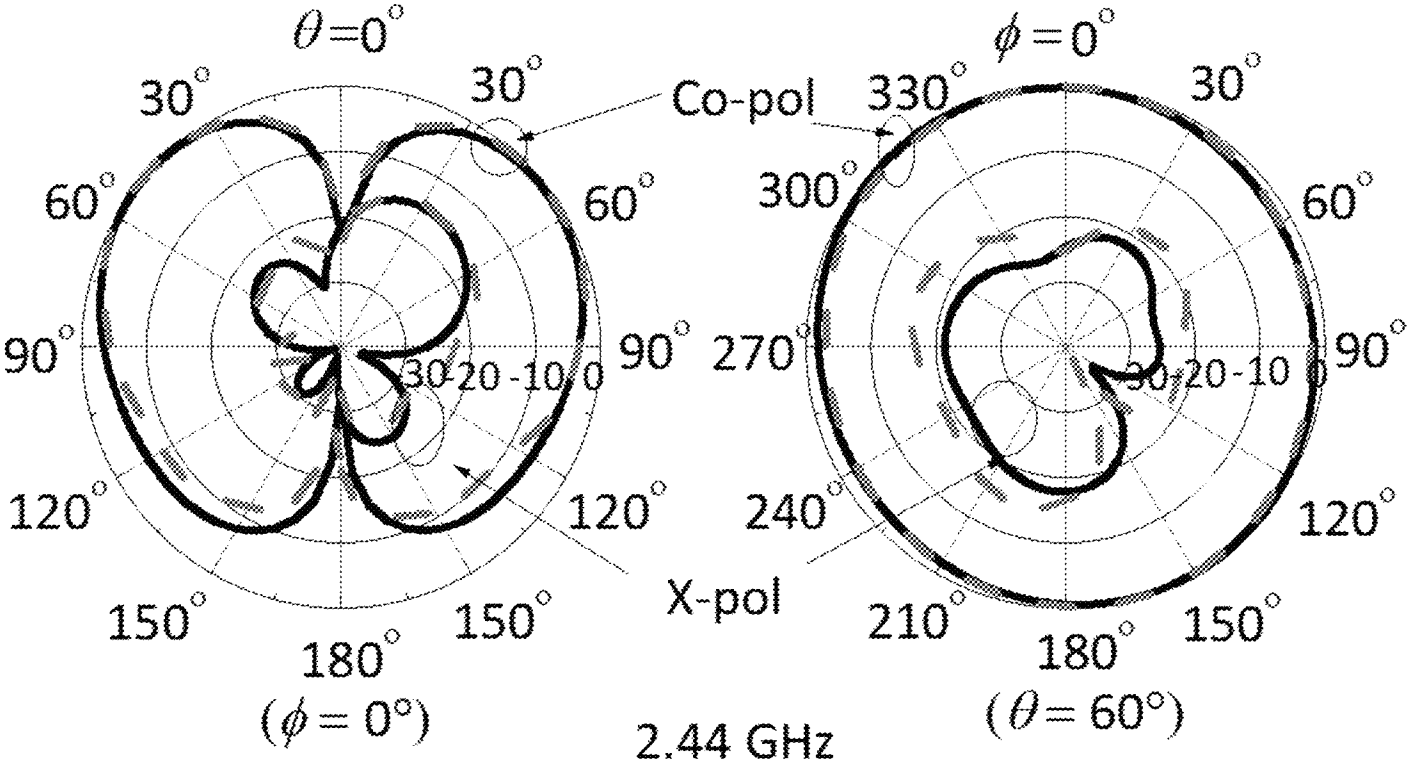
Figure 5E:
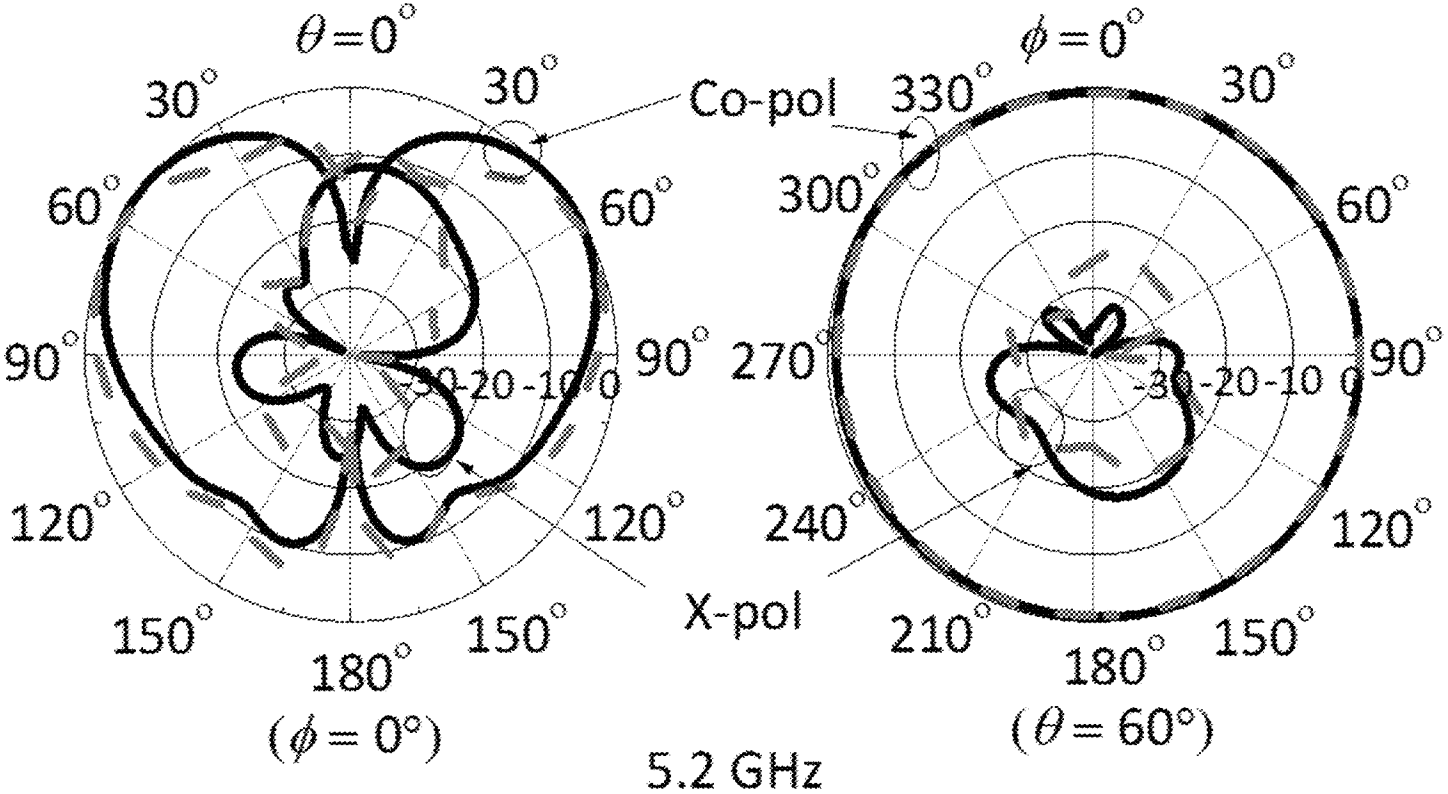
Figure 5F:
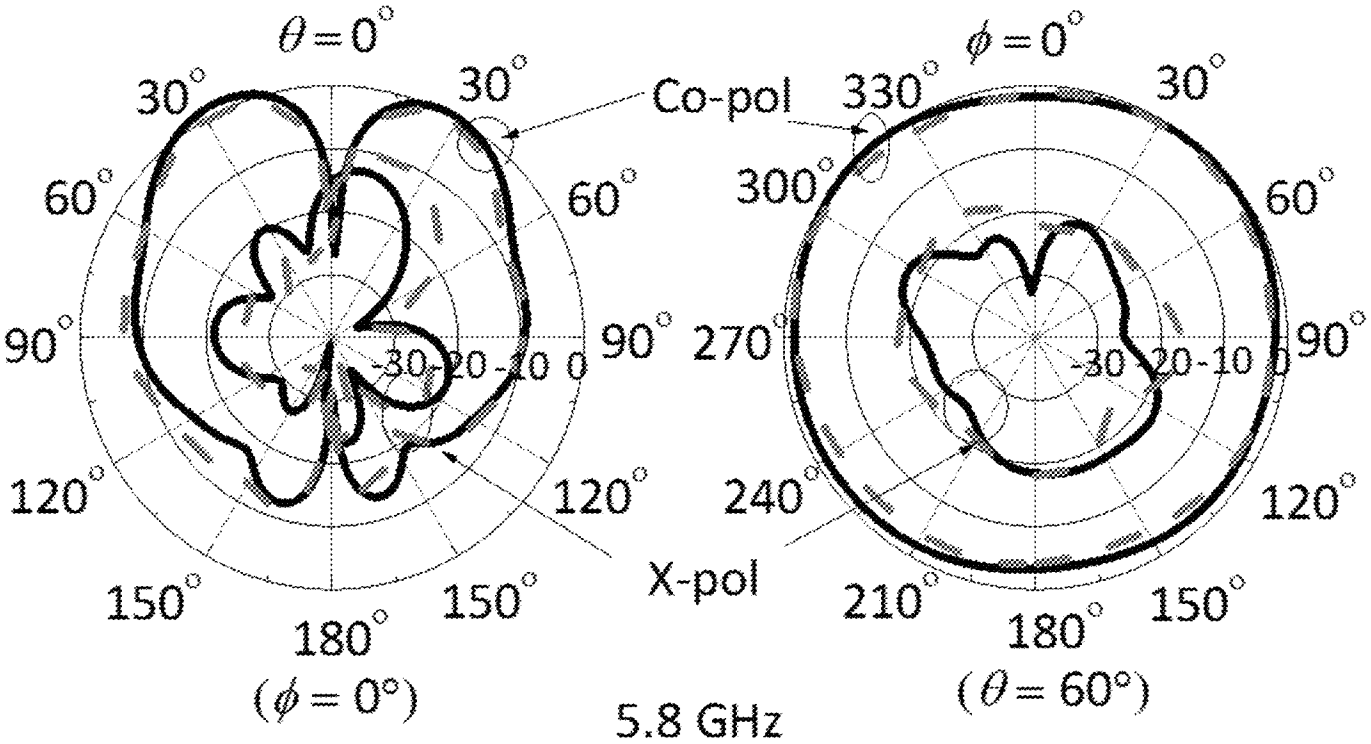

Shown in FIG. 3 is the tri-frequency multi-polarisation omnidirectional antenna 1 of FIG. 1 in vertical cross section. Arranged on the first face 3 is a cylindrical dielectric resonator 20. The dielectric resonator 20 is typically a glass. The dielectric resonator 20 comprises first and second faces 21, 22 and a side wall 23 extending therebetween. The dielectric resonator 20 has a dielectric axis 24 which extends from the middle of the first face 21 to the middle of the second face 22. The first face 21 of the dielectric resonator 20 is arranged on the first face 3 of the substrate 2 with the dielectric axis 24 coaxial with the symmetry axis 18 as shown. The dielectric resonator 20 has a step change in diameter part way along its length. Arranged in the first face 21 of the dielectric resonator 20 is a small recess 25 which reduces the cross polarised fields generated by the power dividers 9, 13.

An aperture 26 extends through the dielectric resonator 20 along the dielectric axis 24. Extending along the dielectric axis 24 is an electrically conductive probe 27 which is connected to a probe port 28 extending through the substrate 2 proximate to the dielectric axis 24. The dielectric resonator 20 is dimensioned such that when excited by a microwave signal provided by the probe 27 it excites vertically polarised TM modes in a lower band and an upper band, the lower band containing 2.4 GHz and the upper band containing 5.2 GHz and 5.8 GHz.

The probe port 28 is connected to a probe signal source 29. The probe signal source 29 is configured to provide a microwave signal at at least one of 2.4 GHz, 5.2 GHz and 5.8 GHz. Preferably the probe signal source 29 is configured to provide a microwave signal at all three frequencies. The first port 10 is connected to a first signal source 30. The first signal source 30 is configured to provide a microwave signal in a lower band at 2.4 GHz. The second port 14 is connected to a second signal source 31. The second signal source 31 is configured to provide a microwave signal in an upper band containing 5.2 GHz and 5.8 GHz. The antenna 1 further comprises a ring slot 32 etched in an electrically conductive ground plane 4*a* on the second side 4 of the substrate 2 for impedance matching of the probe port 28.

In use the probe signal source 29 provides a microwave signal to the probe 27. The probe 27 excites vertically polarised TM modes in the dielectric resonator 20 at one or more of 2.4 GHz, 5.2 GHz and 5.8 GHz. Simultaneously, the first signal source 30 provides a microwave signal to the strips 7 of the outer loop 8 which excites horizontally polarised TE modes in the strips 7 of the outer loop 8 at 2.4 GHz. In addition, the second signal source 31 provides a microwave signal to the strips 11 of the inner loop 12 which excites horizontally polarised TE modes in the composite electrical structure 19 of at least one of 5.2 GHz and 5.8 GHz. In use the antenna 1 according to the invention can therefore operate at all of 2.4 GHz, 5.2 GHz and 5.8 GHz in both TE and TM modes.

FIGS. 4(*a*) to 4(*d*) show the simulated and measured S-parameters, antenna gains, total efficiencies and envelope correlation coefficients for an antenna according to the invention. With reference to FIG. 4(*a*) the measured −10 dB impedance passbands for the probe port (28) are 2.2-2.7 GHz and 5.05-5.86 GHz. As for the first and second ports (10, 14) the measured passband is 2.38-2.5 GHz for the first port (10) and 4.9-5.27 GHz and 5.6-5.85 GHz for the second port (28). Overlapped bandwidths are 4.9% (2.38-2.5), 4.26% (5.05-5.27) and 4.36% (5.6-5.85) fully covering the three Wi-Fi bands. Among the three pairs of modes of orthogonal polarisations there are five dielectric resonator modes and one dielectric resonator loaded probe mode. Also, the port isolations are as high as 30 dB, 25 dB and 20 dB of the three bands. As shown in FIG. 4(*b*) the measured vertically polarised antenna gains at ($\varphi$=0 degrees, $\theta$=sixty degrees) for the probe port (28) are 1, 0.3 and 1.3 dBi at the 2.4-, 5.2-, and 5.8-GHz bands respectively. The measured horizontally polarised gain at this direction is 3 dBi at 2.4 GHz band at the first port (10) whereas they are 2 and -0.75 dBi at the 5.2 and 5.8 GHz bands for the second port (14). The relatively low gain of the 5.8 GHz band is because the peak radiation direction is not at θ=sixty degrees, caused by the increased titled angle of radiation patterns. As can be seen from FIG. 4(*c*) the antenna total efficiencies of the probe port (28) are 93%, 77% and 72% at the three bands which takes impedance matching into account. As for the first and second ports (10, 14) the efficiencies of the three bands are 80%, 73% and 70%. The antenna efficiency of the 5 GHz band is generally lower than that of the 2.4 GHz band. This is expected as the loss caused by the glass increases with frequency. The envelope correlation coefficients (ECCs) of the antenna, which is a performance index for a MIMO antenna, are shown in FIG. 4(*d*). The simulated and measured ECCs were obtained from radiation patterns. Both the simulated and measured ECCs between different polarised ports are lower than −20, −28 and −18 dB for the 2.4-, 5.2- and 5.8 GHz bands respectively. Due to the orthogonal polarisation they are desirably much lower than the criteria of −3 dB.

FIGS. 5(*a*) to 5(*f*) show simulated and measured normalised radiation patterns at 2.44, 5.2 and 5.8 GHz. FIGS. 5(*a*) to 5(*c*) show the patterns for a signal provided to the probe port (28). FIG. 5(*d*) shows the pattern for a signal provided to the first port (10). FIGS. 5(*e*) and 5(*f*) show the radiation pattern for a signal provided to the second port (14). The solid lines show the simulated patterns. The dotted lines show the measured patterns.

The invention claimed is:

1. A tri-frequency multi-polarisation omnidirectional antenna comprising: an electrically insulating substrate comprising first and second faces; a first plurality of curved electrically conductive strips arranged on the first face and being arranged to form an outer loop with each strip being spaced apart from the adjacent strip of the loop; a second plurality of curved electrically conductive strips arranged on the first face and being arranged to form an inner loop with each strip being spaced apart from the adjacent strip of the loop; a third plurality of curved electrically conductive strips arranged on the first face and being arranged to form middle loop with each strip being spaced apart from the adjacent strip of the loop; the three loops being concentric with each loop centered on a common symmetry point, an axis normal to the first face and passing through the common symmetry point being a symmetry axis; the middle loop having a larger diameter than the inner loop and the outer loop having a larger diameter than the middle loop; a first power divider connected to the strips of the outer loop; a second power divider connected to the strips of the inner loop; a dielectric resonator comprising a first face, the first face arranged on the first face of the substrate; an electrically conductive probe being arranged at least partially within the dielectric resonator and extending at least part way along the symmetry axis.

2. A tri-frequency multi-polarisation omnidirectional antenna as claimed in claim 1, wherein the loops are circular.

3. A tri-frequency multi-polarisation omnidirectional antenna as claimed in claim 1, wherein the dielectric resonator is cylindrical and comprises first and second faces and a side wall extending therebetween, the resonator comprising a dielectric axis extending from the center of the first face to the center of the second face, the dielectric axis being coaxial with the symmetry axis.

4. A tri-frequency multi-polarisation omnidirectional antenna as claimed in claim 3, wherein the dielectric resonator comprises at least one step change in diameter part way along its length.

5. A tri-frequency multi-polarisation omnidirectional antenna as claimed in claim 1, wherein the dielectric resonator is dimensioned such that when excited by an microwave signal provided to it by the probe it excites vertically polarised TM modes in a lower band and an upper band, the lower band containing 2.4 GHz and the upper band containing 5.2 GHz and 5.8 GHz.

6. A tri-frequency multi-polarisation omnidirectional antenna as claimed in claim 1, wherein the dielectric resonator is glass.

7. A tri-frequency multi-polarisation omnidirectional antenna as claimed in claim 1 further comprising a probe signal source connected to the probe, the probe signal source being configured to provide a microwave signal at at least one of 2.4 GHz, 5.2 GHz and 5.8 GHz.

8. A tri-frequency multi-polarisation omnidirectional antenna as claimed in claim 1 wherein the loops are circular.

9. A tri-frequency multi-polarisation omnidirectional antenna as claimed in claim 1, wherein the middle loop is arranged proximate to the inner loop such that the two are electrically coupled together to form a composite electrical structure.

10. A tri-frequency multi-polarisation omnidirectional antenna as claimed in claim 9 wherein the strips of the composite electrical structure are dimensioned such that when excited by a microwave signal the composite electrical structure excites horizontally polarised TE modes in an upper frequency band, the upper frequency band containing 5.2 GHz and 5.8 GHz.

11. A tri-frequency multi-polarisation omnidirectional antenna as claimed in claim 1, further comprising a second signal source connected to the second power divider, the second signal source being configured to provide a microwave signal at at least one of 5.2 GHz and 5.8 GHz.

12. A tri-frequency multi-polarisation omnidirectional antenna as claimed in claim 1, wherein the strips of the outer loop are dimensioned such that when excited by a microwave signal the outer loop excites a horizontally polarised TE mode in a lower frequency band, the lower frequency band containing 2.4 GHz.

13. A tri-frequency multi-polarisation omnidirectional antenna as claimed in claim 1 further comprising a first signal source connected to the first power divider, the first signal source being configured to provide a microwave signal at 2.4 GHz.

14. A tri-frequency multi-polarisation omnidirectional antenna as claimed in claim 1 further comprising an electrically conductive ground plane on the second side of the substrate.

15. A tri-frequency multi-polarisation omnidirectional antenna as claimed in claim 14 further comprising a ring slot in the ground plane.

16. A tri-frequency multi-polarisation omnidirectional antenna as claimed in claim 1 further comprising a recess in the first face of the dielectric resonator arranged about the symmetry axis.

* * * * *